United States Patent [19]

Westdale

[11] 4,419,959

[45] Dec. 13, 1983

[54] MAGNETIC TONER RETAINER MEANS

[75] Inventor: Virgil W. Westdale, Barrington, Ill.

[73] Assignee: AM International, Inc., Chicago, Ill.

[21] Appl. No.: 427,152

[22] Filed: Sep. 29, 1982

[51] Int. Cl.[3] ..... G03G 21/00

[52] U.S. Cl. ..... 118/657; 118/652; 118/658

[58] Field of Search ..... 118/657, 652, 658; 430/122; 355/15

[56] References Cited

U.S. PATENT DOCUMENTS 4,127,084 11/1978 Quang ..... 118/657

4,210,397 7/1980 Macaluso et al. ..... 355/15

*Primary Examiner*—John P. McIntosh

*Attorney, Agent, or Firm*—Nicholas A. Camasto; John R. Hoffman

[57] ABSTRACT

A magnetic toner developing system has a hopper feeding magnetic toner to a magnetic roller brush positioned over a non-magnetic guide that supports a sheet in its passage through a development zone. A plurality of magnets are mounted beneath the guide and restrain any toner on the underside of the sheet from being carried away from the development zone. The stronger magnetic field of the developer brush attracts the restrained toner as the sheet is transported out of the development zone.

6 Claims, 3 Drawing Figures

Fig. 1
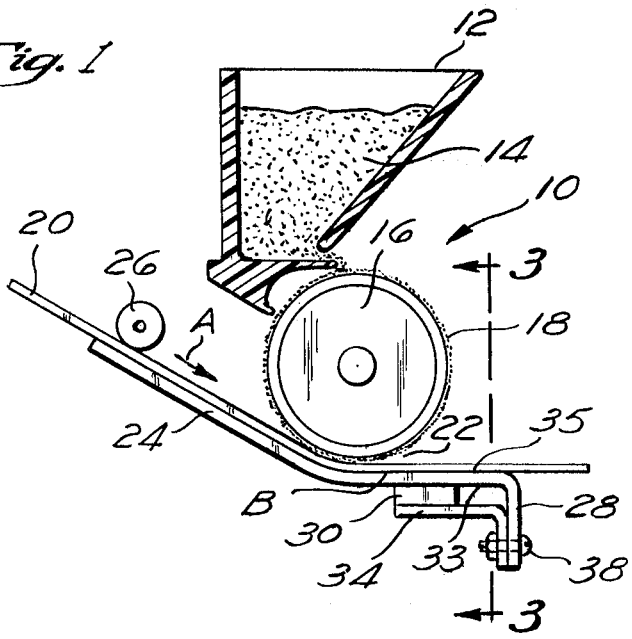
Fig. 2
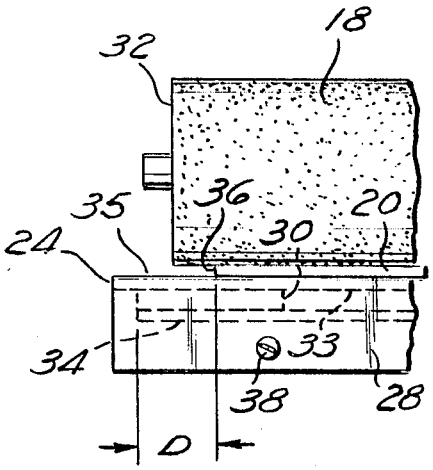
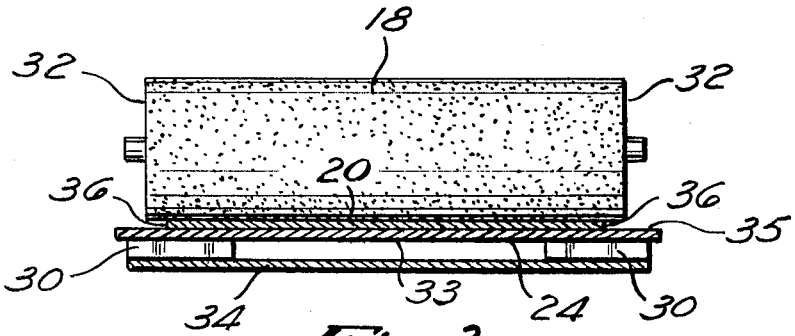
Fig. 3

MAGNETIC TONER RETAINER MEANS

CROSS REFERENCE TO RELATED APPLICATION

This application is related to applications Ser. No. 427,153 filed Sept. 29, 1982 and Ser. No. 467,781 filed Feb. 18, 1983 in the name of the inventor and assigned to AM International.

BACKGROUND OF THE INVENTION

The present invention relates generally to magnetic toner retaining means for removing excess toner from a photoconductive member such as an electrostatically imaged lithographic master sheet and, particularly, to magnetic means for retaining excess toner at a development zone to prevent its being carried away by the master sheet and contaminating the reproduction equipment.

In the lithographic printing and duplicating field, various types of planographic printing plates or masters are used for reproducing copies. A master may receive a direct image from a typewriter or the like, a photographic image on a suitably sensitized surface or an electrostatic image on a photoconductive surface, normally comprising zinc oxide. In the latter system, the photoconductive surface of the master is exposed to an original to be copied via an optical projection system to produce an electrostatic latent image which is subsequently developed with a magnetic toner to produce a visible image. The developed master may be treated with a conversion solution to provide a lithographic surface for producing offset lithographic copies in a conventional manner.

Difficulty is often experienced in keeping the master sheet free of excess toner deposited during the development process which toner works its way to the underside of the sheet. The excess toner may be carried out of the development zone by the master sheet resulting in lost toner, and of even more concern, contamination of the reproduction system. Usually, the unwanted toner deposits accumulate along the margins of the master sheet, especially where the magnetic roller brush for applying toner to the master is longer than the width of the master.

There are many known devices such as filters, toner traps and cleaning rollers which are used to help reduce toner contamination of the reproduction equipment and surrounding areas. Such devices are generally complex, expensive or of limited capacity.

SUMMARY OF THE INVENTION

In accordance with the invention, a magnetic toner system has a development zone including a magnetic developer roller brush, a hopper dispensing toner to the brush, nonmagnetic guide means supporting a master sheet for development adjacent the surface of the roller brush, means transporting the sheet through the development zone, and magnet means for restraining any excess toner on the underside of the sheet from being carried away from the development zone.

OBJECTS OF THE INVENTION

It is a principal object of the invention to provide an improved magnetic toner development system.

Another object of the invention is to provide a magnetic toner development system having minimum toner carryout.

Other objects, features and advantages of the invention will be apparent from a reading of the following description thereof in conjunction with the drawing in which;

BRIEF DESCRIPTION OF THE DRAWING

FIG. 1 is a simplified end view of a magnetic toner developing system including magnet means for removing excess toner from a master sheet in accordance with the present invention;

FIG. 2 is a fragmentary front view of the apparatus of FIG. 1; and

FIG. 3 is a sectional view taken along line 3—3 of FIG. 1.

DESCRIPTION OF THE PREFERRED EMBODIMENT

With reference to FIG. 1, the toner system comprises a magnetic developer roller brush indicated generally by reference numeral 10 and a toner supply hopper 12 for dispensing magnetic toner 14 onto the peripheral surface of the roller brush. Roller brush 10 has a magnetic core 16 rotatable within a stationary outer sleeve 18. The magnetic field of the roller brush attracts toner to the surface of sleeve 18 and creates a brush-like surface for conveying toner from hopper 12 to the face of a master sheet 20 as it is transported through a development zone 22 by conventional means (not shown). The roller brush is mounted transverse to the direction of movement (arrow A) of master 20 through development zone 22.

In operation, there is a tendency for the toner to "creep" around the edges of the master sheet and adhere to the bottom surface thereof. It should be obvious that any toner on the back (non-imaged side) of the master will be carried out of the development zone and not only be wasted, but contaminate the rest of the equipment.

A guide 24 supports master sheet 20 in the development zone. Guide 24 extends from a position adjacent a feed roller 26, downwardly into close proximity to the lower portion of roller brush 10, laterally out of the development zone and terminates in a downwardly formed lip 28. The guide may be constructed of any suitable non-magnetic material such as plastic, anodized aluminum or stainless steel.

Magnet means, comprising a pair of magnets 30, are positioned in spaced apart relation on the underside 33 of guide 24 adjacent to the ends 32 of the roller brush. Each magnet is supported by a suitable bracket 34 secured to lip 28 of the guide with appropriate fasteners 38. As best seen in FIG. 3, the magnets are mounted so portions extend beyond the side edges 36 of the master and the ends of the roller brush. Preferably, the length of each magnet is approximately 25% of the roller brush length and each extends about one inch (2.54 cm. dimension D) beyond the edge of the master sheet.

The magnets have a field strength that is less than the field strength of roller brush 10, but of sufficient strength to retain excess toner on master sheet 20 from leaving development zone 22 as the sheet is transported through the development zone. Because of their low strength, as the trailing edge of the master exits from the development zone, the retained toner that is deposited on the upper surface 35 of guide member 24 when the sheet leaves is attracted by magnetic roller brush 10.

The magnets are positioned below the non-magnetic guide and the requisite field strength on the top surface of the guide (in contact with the back side of sheet 20) was determined for effective toner retention. The nominal strength of magnets used was 600 Gauss and the field strength produced at the upper surface of the guide member was approximately 300 Gauss.

The field strength of the magnetic roller brush, positioned at normal developing distances from the top of the guide member was about 600 Gauss. Consequently any toner desposited on the guide when the sheet was transported out of the development zone was immediately attracted to the roller brush and salvaged.

Copy sheets or masters of relatively long length may result in toner build-up in excess of the holding capacity of the magnets. Larger magnets or more than one magnet on each side may be used to increase holding capacity.

From the foregoing, it will be appreciated that the present invention provides apparatus for removing unwanted toner from the back of a master sheet, which is simple in construction, inexpensive to produce and reliable in operation. The retained toner deposits are removed when the sheet leaves the development zone. The invention doesn't require the developer roller to be shorter than the width of the sheet.

It is recognized that numerous modifications and changes in the described embodiments will be apparent to those skilled in the art within departing from the invention which is to be limited only as defined in the claims.

What is claimed is:

1. A magnetic toner system, having a development zone, including:

a magnetic developer roller brush in said development zone;

a hopper for dispensing magnetic toner to said roller brush;

non-magnetic guide means supporting a master sheet for development adjacent the surface of said roller brush;

means transporting said sheet through said development zone; and magnet means in the development zone for restraining any toner on the bottom of said sheet from being carried out of said development zone as said sheet is transported therethrough, said magnet means having a field strength that is weaker than the field strength of said magnetic roller brush.

2. The system of claim 1 wherein said magnet means are located beneath said guide means.

3. The system of claim 2 wherein said magnet means comprise individual magnets positioned adjacent the side edges of said master sheet.

4. The system of claim 3 wherein said individual magnets have a length approximately 25% of the length of said roller brush.

5. A magnetic toner system, having a development zone, including:

a magnetic developer roller brush in said development zone for receiving magnetic toner;

means for transporting a master sheet through said development zone for development adjacent the surface of said roller brush; and magnet means in the development zone for attracting excess toner from said master sheet to prevent the toner from being carried out of said development zone as said sheet is transported therethrough, said magnet means having a field strength that is weaker than the field strength of said magnetic roller brush whereby the toner which is retained by the magnet means is attracted by the magnetic roller brush as the trailing edge of the master sheet exits from the development zone.

6. The system of claim 5 wherein said magnet means comprise individual permanent magnets positioned adjacent the side edges of said master sheet.

* * * * *